US006712548B1

(12) United States Patent
Rogers et al.

(10) Patent No.: US 6,712,548 B1
(45) Date of Patent: Mar. 30, 2004

(54) TEMPORARY RAISED PAVEMENT MARKER (TRPM) APPLICATOR MACHINE FOR AUTOMATICALLY APPLYING PAVEMENT MARKERS TO ROAD SURFACES

(75) Inventors: Jeffrey Rogers, Alexandria, MN (US); Brad Anderson, Alexandria, MN (US); Chad Orthaus, Alexandria, MN (US); Jeffrey Arnold Wilkens, Reiles Acres, ND (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/367,823

(22) Filed: Feb. 19, 2003

(51) Int. Cl.[7] ..... E01C 23/16

(52) U.S. Cl. ..... 404/72; 404/94; 404/93; 404/99; 221/253

(58) Field of Search ..... 404/72, 93, 94, 404/99; 222/160; 221/1, 253

(56) References Cited

U.S. PATENT DOCUMENTS

| | | | | |
|---|---|---|---|---|
| 1,221,689 A | * | 4/1917 | Coyne | 404/99 |
| 1,766,073 A | | 6/1930 | Hartzler et al. | |
| 1,833,124 A | | 11/1931 | Rand | |
| 3,380,428 A | | 4/1968 | Abrams | |
| 3,963,362 A | | 6/1976 | Hollis | |
| 4,089,730 A | * | 5/1978 | Mahn | 156/541 |
| 4,111,581 A | | 9/1978 | Auriemma | |
| 4,236,950 A | * | 12/1980 | Eigenmann | 156/71 |
| 4,279,534 A | * | 7/1981 | Eigenmann | 404/72 |
| 4,445,803 A | | 5/1984 | Dixon | |
| 4,521,129 A | | 6/1985 | Krech et al. | |
| 4,534,673 A | | 8/1985 | May | |
| 4,542,709 A | | 9/1985 | Spaugh | |
| 4,607,978 A | * | 8/1986 | Eigenmann | 404/73 |
| 4,645,168 A | | 2/1987 | Beard | |
| 4,792,259 A | * | 12/1988 | Eigenmann | 404/73 |
| 4,936,485 A | * | 6/1990 | Downing | 221/297 |
| 4,974,990 A | * | 12/1990 | Anderson et al. | 404/94 |
| 4,991,994 A | | 2/1991 | Edouart | |
| 5,327,850 A | | 7/1994 | Sly et al. | |
| 5,392,728 A | | 2/1995 | Speer et al. | |
| 5,393,166 A | | 2/1995 | Stock et al. | |
| 5,460,115 A | | 10/1995 | Speer et al. | |
| 5,515,807 A | | 5/1996 | Speer et al. | |
| 5,788,405 A | | 8/1998 | Beard | |
| 5,853,263 A | * | 12/1998 | Green | 404/94 |
| 6,109,820 A | | 8/2000 | Hughes, Sr. | |

FOREIGN PATENT DOCUMENTS

| | | |
|---|---|---|
| WO | WO95/2731 | 1/1995 |

* cited by examiner

*Primary Examiner*—Gary S. Hartmann
(74) *Attorney, Agent, or Firm*—Schwartz & Weinrieb

(57) ABSTRACT

Apparatus and method for applying temporary raised pavement markers (TRPM) to roadway surfaces comprises a conveyor upon a wheeled vehicle wherein an upstream end portion of the conveyor is able to extend, for example, over the rear bed portion of a roadwork vehicle so as to permit an operator, stationed upon the bed portion of the roadwork vehicle, to deposit pavement markers upon the conveyor. A pair of wheel applicators are used for applying the temporary raised pavement markers (TRPMs) onto the roadway surface. A hitch mechanism is also used to provide hinged movement between the tow bar of the towed wheeled vehicle and the mounting bar of the towing roadwork vehicle so as to permit independent elevational movement of the towed wheeled vehicle relative to the towing roadwork vehicle.

26 Claims, 9 Drawing Sheets

TEMPORARY RAISED PAVEMENT MARKER (TRPM) APPLICATOR MACHINE FOR AUTOMATICALLY APPLYING PAVEMENT MARKERS TO ROAD SURFACES

CROSS REFERENCE TO RELATED PATENT APPLICATION

This patent application is related in subject matter to the United States patent application which is entitled TEMPORARY RAISED PAVEMENT MARKER (TRPM) APPLICATOR MACHINE FOR AUTOMATICALLY APPLYING PAVEMENT MARKERS TO ROAD SURFACES, which was filed on Sep. 20, 2002, and which has been assigned Ser. No. 10/247,436.

FIELD OF THE INVENTION

The present invention relates generally to temporary raised pavement markers (TRPMS) which are adapted to be fixedly secured to roadway surfaces in order to, for example, temporarily define traffic lanes or the like within construction zones, work sites, or maintenance or repair areas, and more particularly to a new and improved machine for automatically applying such temporary raised pavement markers (TRPMs) to the roadway surfaces within such construction zones, work sites, or maintenance or repair areas.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are to be removed. In addition, to be effective, the temporary roadway markers must be capable of clearly alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various impact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM). Examples of such temporary raised pavement markers (TRPMs) are disclosed, for example, within U.S. Pat. No. 6,109,820 which issued to Hughes, Sr. on Aug. 29, 2000, U.S. Pat. No. 5,788,405 which issued to Beard on Aug. 4, 1998, U.S. Pat. No. 5,460,115 which issued to Speer et al. on Oct. 24, 1995, U.S. Pat. No. 4,991,994 which issued to Edouart on Feb. 12, 1991, and U.S. Pat. No. 4,445,803 which issued to Dixon on May 1, 1984.

As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication that the motorist is approaching or entering a construction zone or work area. Alternatively, in lieu of the reflective strip 23, the entire marker 10 may simply be brightly colored so as to similarly provide the oncoming motorist with the necessary visual warning.

With reference being further made to FIG. 2, a temporary raised pavement marker (TRPM), which is similar to the temporary raised pavement marker (TRPM) 10 disclosed in FIG. 1 of the present drawings as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. An adhesive pad 118 is fixedly secured to an undersurface or lower face portion of the horizontally disposed leg or base member 112, and in turn, a release sheet 120 is secured to an undersurface or lower face portion of the adhesive pad 118 so as to prevent the adhesive pad 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPMS) 110 are normally placed upon the roadway surface during an extended period of time that construction or other road work is being performed upon the roadway surface, and therefore prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114 when such portion of the temporary raised pavement marker (TRPM) 110 is to be used as the visual warning to oncoming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110.

When the temporary raised pavement markers (TRPMs) 110 are to be subsequently used in conjunction with, for example, their traffic lane delineation functions, the protective covers 126 are removed, and still further, when the need for the temporary raised pavement markers (TRPMs) 110 is no longer required in view of the completion of the construction or other roadwork, and the application of the permanent traffic lane lines to the roadway surface, the temporary raised pavement markers (TRPMs) 110 must obviously be removed from the roadway surface. Until now, the process for mounting and securing the temporary raised pavement markers (TRPMs) 110 upon the roadway surfaces was accomplished manually whereby construction workmen or other personnel would have to manually deposit the temporary raised pavement markers (TRPMs) 110 onto the roadway surface as a result of, for example, removing the release sheet 120 and pressing the temporary raised pavement marker (TRPM) 110 onto the roadway surface so as to cause the adhesive bonding of the same to the roadway surface. Obviously, such procedures are quite tedious and time-consuming. In addition, in view of the fact that the construction workmen or other personnel are physically present upon the particular roadway surface during the performance of such temporary raised pavement marker (TRPM) application operations, the workmen or personnel are necessarily exposed to dangerous vehicular conditions present upon the roadway which is obviously undesirable from a safety point of view.

A need therefore exists in the art for a new and improved device, machine, or apparatus for automatically applying temporary raised pavement markers (TRPMs) to roadway surfaces so as to serve their useful purposes and functions in defining or delineating traffic lanes within construction zones or maintenance and repair areas, wherein, in particular, the temporary raised pavement markers (TRPMs) can be applied to the roadway surface in a relatively rapid manner, wherein the construction workmen or other operator personnel do not need to tediously perform such removal operations manually, and in addition, and just as importantly, wherein the operator personnel or construction workers will not be needlessly exposed to dangerous roadway conditions presented by oncoming automotive vehicular traffic. In addition, a need exists in the art for ensuring the fact that the apparatus for applying the temporary raised pavement markers (TRPMs) onto the roadway surface is properly maintained in engagement with the roadway surface despite irregularities encountered during movement along the roadway surface.

OBJECTS OF THE INVENTION

Accordingly, it is an object of the present invention to provide a new and improved device or apparatus for applying temporary raised pavement markers (TRPMs) to roadway surfaces.

Another object of the present invention is to provide a new and improved device or apparatus for applying temporary raised pavement markers (TRPMS) to roadway surfaces whereby the operational drawbacks and disadvantages characteristic of the PRIOR ART techniques currently employed for applying the temporary raised pavement markers (TRPMs) to the roadway surfaces are effectively overcome.

An additional object of the present invention is to provide a new and improved device or apparatus for applying temporary raised pavement markers (TRPMs) to roadway surfaces wherein the temporary raised pavement markers (TRPMs) can be automatically applied to the roadway surfaces.

A further object of the present invention is to provide a new and improved device or apparatus for applying temporary raised pavement markers (TRPMs) to roadway surfaces wherein the temporary raised pavement markers (TRPMs) can be automatically applied to the roadway surfaces such that construction workers or other operator personnel do not have to manually apply such temporary raised pavement markers (TRPMS) to the roadway surfaces in a tedious and relatively slow manner, and wherein further, the workmen or other personnel are not unnecessarily exposed to dangerous roadway conditions presented by oncoming automotive vehicular traffic.

A last object of the present invention is to provide a new and improved device or apparatus for applying temporary raised pavement markers (TRPMs) to roadway surfaces wherein the temporary raised pavement markers (TRPMs) can be automatically applied to the roadway surfaces such that the construction workers or other operator personnel do not have to manually apply such temporary raised pavement markers (TRPMs) to the roadway surfaces in a tedious and relatively slow manner, wherein the workmen or other personnel are not unnecessarily exposed to dangerous roadway conditions presented by oncoming automotive vehicular traffic, and wherein the hitch mechanism interconnecting the towed vehicle to the roadwork service vehicle permits the towed vehicle to move independently of the roadwork service vehicle so as to ensure the fact that the wheel applicators of the towed vehicle always remain properly engaged with the roadway surface.

SUMMARY OF THE INVENTION

The foregoing and other objectives are achieved in accordance with the teachings and principles of the present invention through the provision of new and improved towed vehicle comprising apparatus or machinery for automatically applying temporary raised pavement markers (TRPMS) to roadway surfaces wherein the towed vehicle is operatively connected to a roadwork service vehicle or truck by means of a suitable hitch mechanism so as to be towed along a roadway surface onto which a plurality of temporary raised pavement markers (TRPMs) are to be placed. The machine or apparatus comprises a pair of conveyors wherein the temporary raised pavement markers (TRPMs) are deposited upon upstream end portions of the conveyors by means of an operator or workman stationed within a rear portion of the roadwork service vehicle or truck, and the conveyors convey the temporary raised pavement markers (TRPMS) downstream to lower end portions disposed immediately above the roadway surface. A pair of applicator wheels are disposed adjacent to the lower end portions of the conveyors, and in this manner, as the temporary raised pavement markers (TRPMs) are serially dispensed and discharged from the lower end portions of the conveyors and onto the roadway surface such that the normally vertical leg portion of each one of the temporary raised pavement markers (TRPMs) is disposed in a horizontal mode or orientation upon the roadway surface, the applicator wheels effectively roll over the temporary raised pavement markers (TRPMs), engage the normally horizontal leg portion of each one of the temporary raised pavement markers (TRPMs), which at this point in time is disposed vertically, and cause each one of the temporary raised pavement markers (TRPMs) to rotate about its transitional corner region such that the normally horizontal leg portion of each one of the temporary raised pavement markers (TRPMs) is now secured to the roadway surface by means of its adhesive pad.

In addition to the conveyor and applicator wheel apparatus for achieving the automatic application of the temporary raised pavement markers (TRPMs) onto the roadway surface, the hitch mechanism operatively interposed between the roadwork service vehicle and the towed vehicle provides for pivotal movement of the hitch mechanism so as to permit the towed vehicle, upon which the conveyors are disposed, to effectively move independently of the roadwork service vehicle such that the towed vehicle, and the conveyor and wheel applicator mechanisms thereof, are always maintained properly engaged with, and with respect to, the roadway surface upon which the temporary raised pavement markers (TRPMs) are to be applied. Application of the tempoorary raised pavement markers (TRPMS) onto the roadway surface in adjacent pairs simulates, for example, double-yellow traffic lane lines for separating opposite lanes of vehicular traffic.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
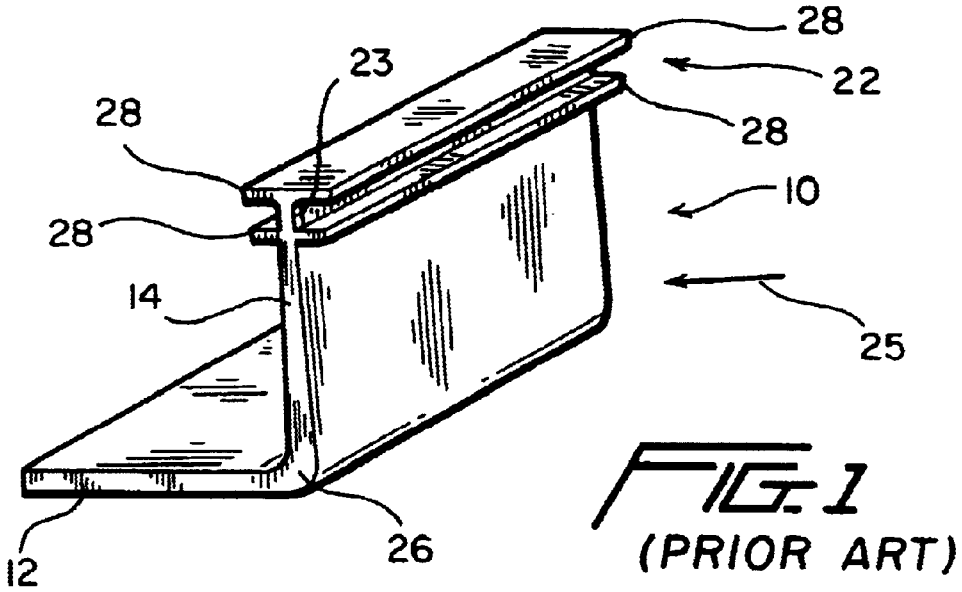
FIG. 1 (PRIOR ART)
FIG. 1 is a perspective view of a conventional PRIOR ART temporary raised pavement marker (TRPM)
Figure 2:
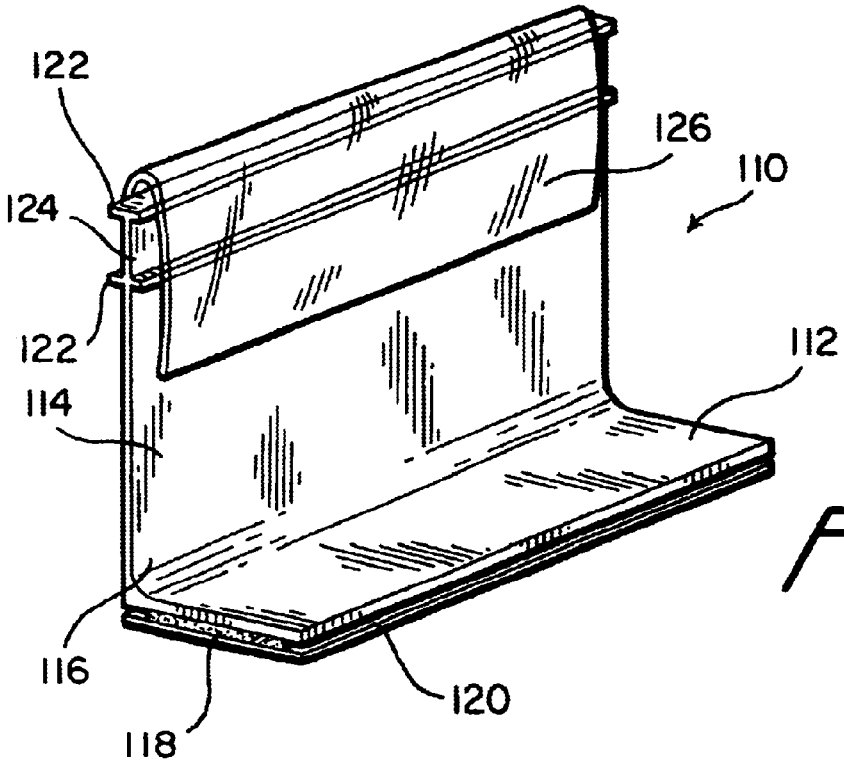
FIG. 2 is a perspective view of a temporary raised pavement marker (TRPM) of the type which is adapted to be applied to a roadway surface, by means of the device, machine, or apparatus constructed in accordance with the principles and teachings of the present invention, in order to desirably define or delineate simulated roadway traffic lines.

Referring now to the drawings, and more particularly to FIGS. 3–7 and 12 thereof, a new and improved apparatus or machine for automatically applying temporary raised pavement markers (TRPM) to roadway surfaces is disclosed and is generally indicated by the reference character 210. The machine or apparatus 210 is seen to comprise a wheeled vehicle 212 comprising a vehicle chassis or framework 214 which is rollably supported by means of a pair of transport wheel assemblies 216, and a trailer hitch assembly 218 which permits the machine or apparatus 210 to be pulled along a roadway surface 220 by means of a roadwork service vehicle or truck 222, the vehicle 212 adapted to also comprise an enclosure, not shown. More particularly, and as will be described in more detail hereinafter, the trailer hitch assembly 218 is seen to comprise a longitudinally extending tow bar 224 which is integrally connected to the towed vehicle chassis or framework 214, and a transversely extending pivotal hitch connector 226 which is adapted to interconnect the tow bar 224 of the trailer hitch assembly 218 to a fixed tubular mounting bar 228 which is fixedly mounted upon a rear end chassis portion of the roadwork service vehicle or truck 222.

Figure 4:
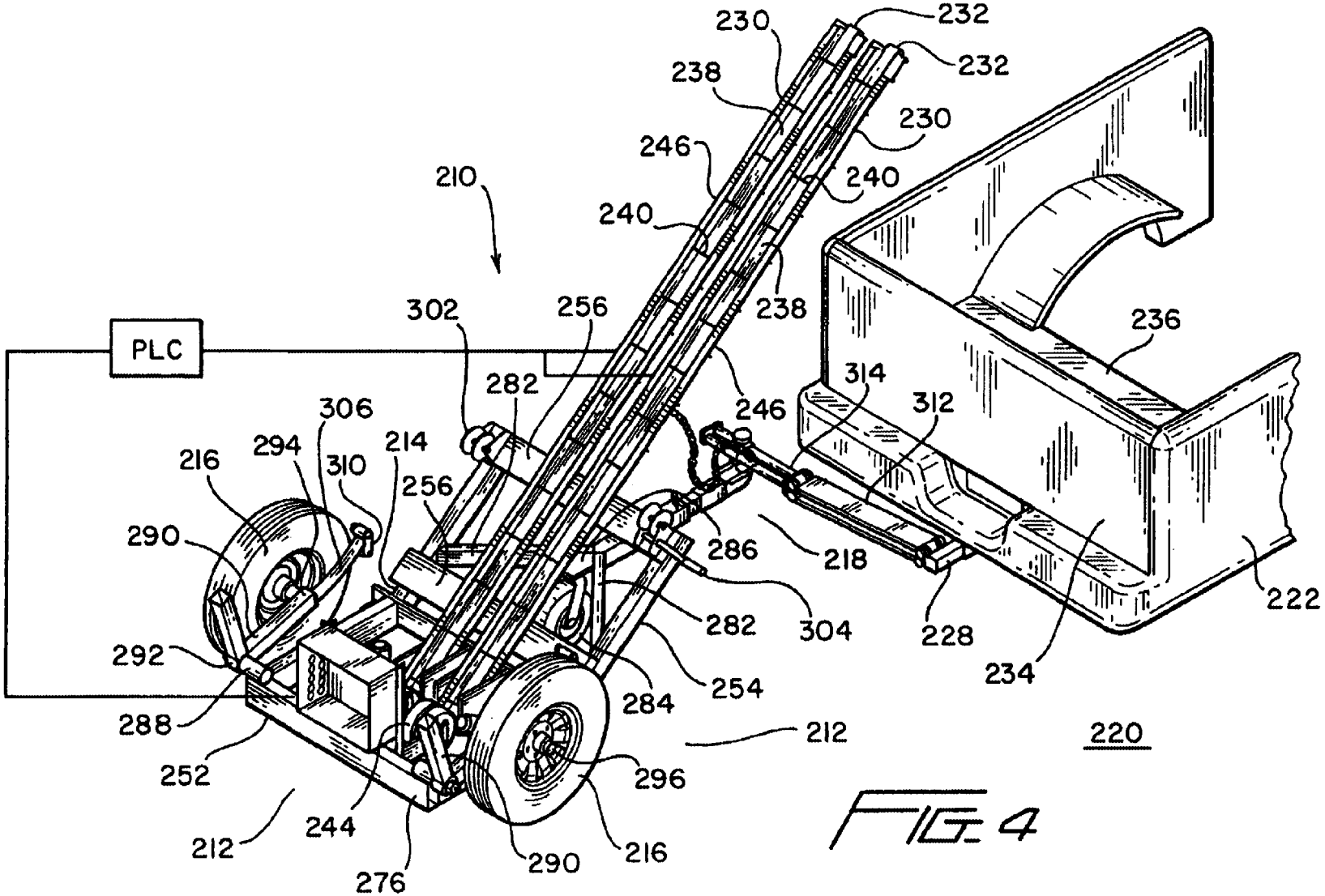
FIG. 4 is an assembled perspective view, similar to that of FIG. 3, showing the new and improved apparatus, for automatically applying temporary raised pavement markers (TRPMs) onto the roadway surface, as well as the new and improved hitch mechanism for interconnecting the towed vehicle to the roadwork service vehicle such that the new and improved apparatus for automatically applying temporary raised pavement markers (TRPMs) onto the roadway surface is disposed in its marker application mode.
Figure 5:
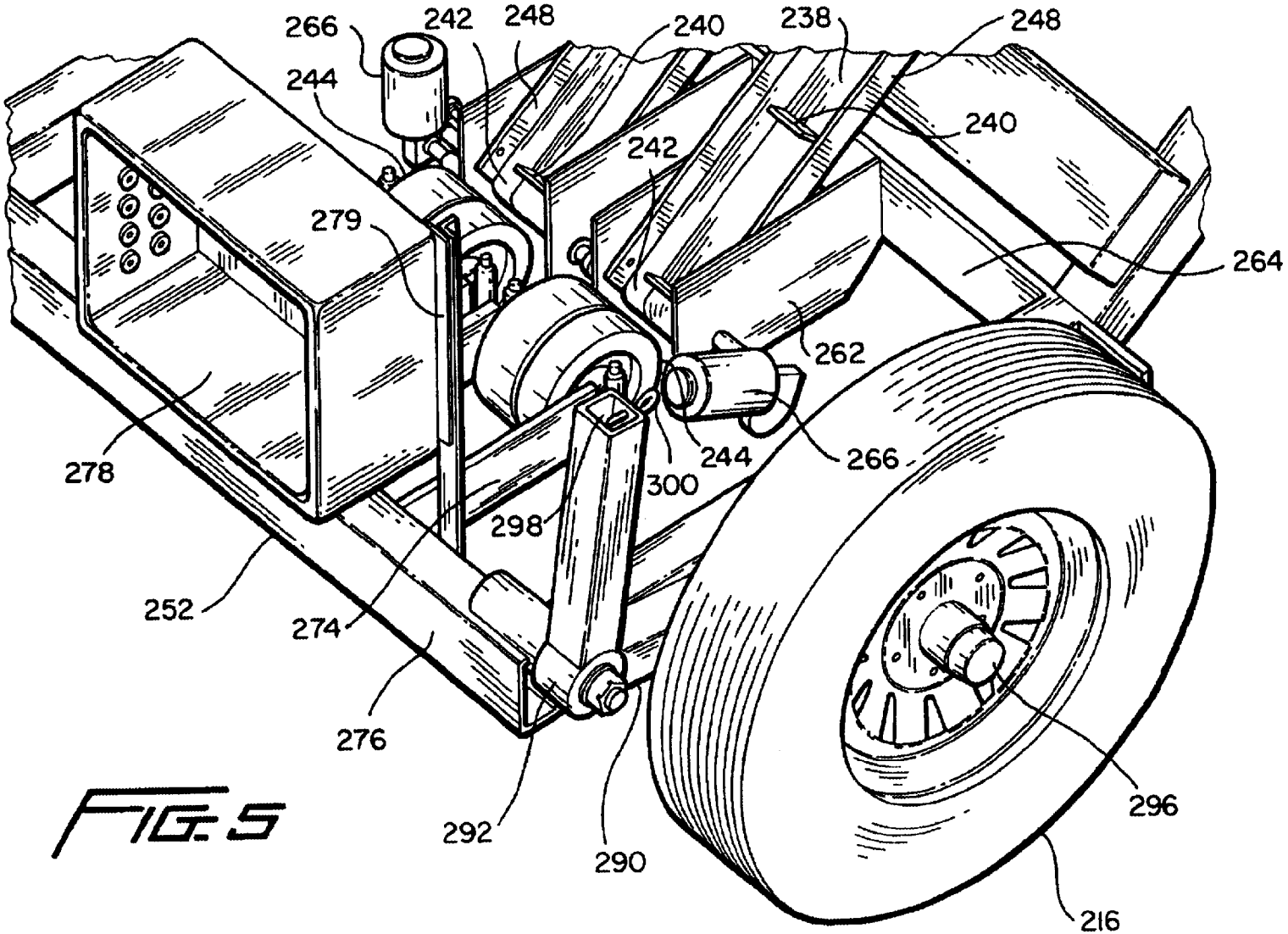
FIG. 5 is an enlarged perspective view showing the details of the lower end portion of the pair of conveyor mechanisms of the new and improved apparatus of the present invention for delivering and discharging the temporary raised pavement markers (TRPMs) onto the roadway surface such that the temporary raised pavement markers (TRPMs) can be secured to the roadway surface by the applicator wheel assemblies.
Figure 6:
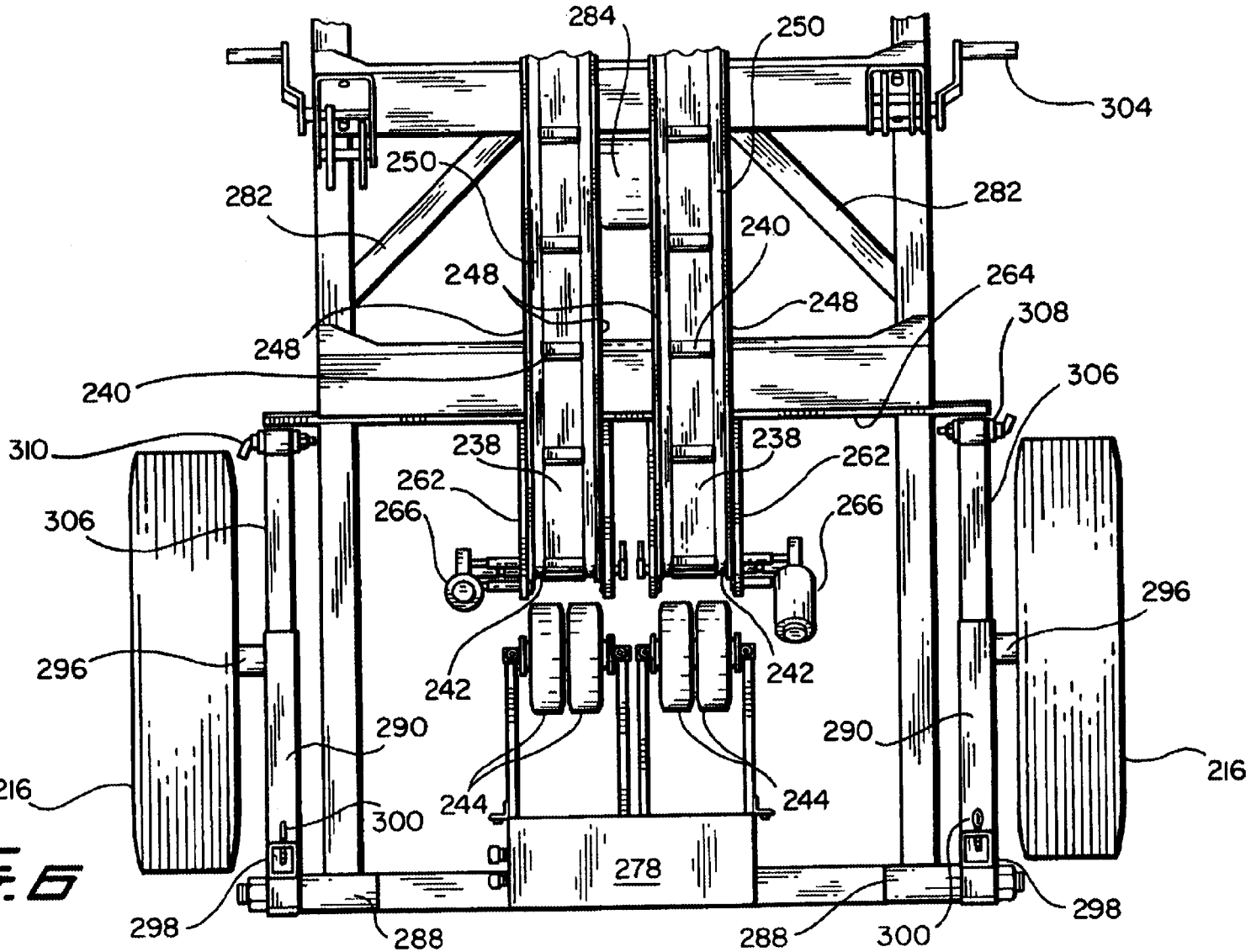
FIG. 6 is a top plan view of the new and improved apparatus of the present invention comprising the conveyor mechanisms for delivering and discharging the temporary raised pavement markers (TRPMS) onto the roadway surface, as well as the wheel applicator assemblies for applying and securing the temporary raised pavement markers (TRPMs) onto the roadway surface.
Figure 7:
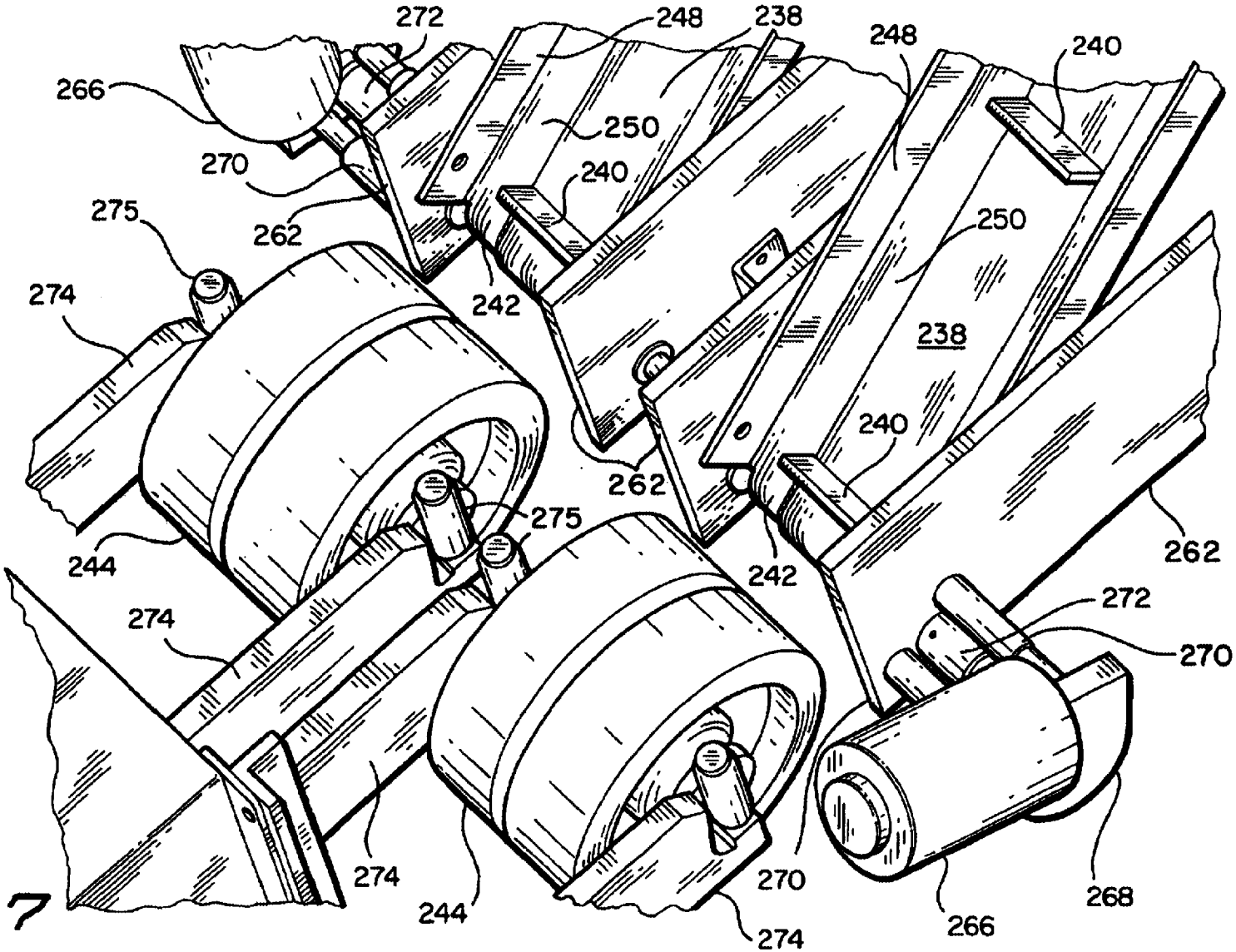
FIG. 7 is an enlarged perspective view similar to that of FIG. 5 showing additional details of the lower end portions of the temporary raised pavement marker (TRPM) conveyor mechanisms.
Figure 8:
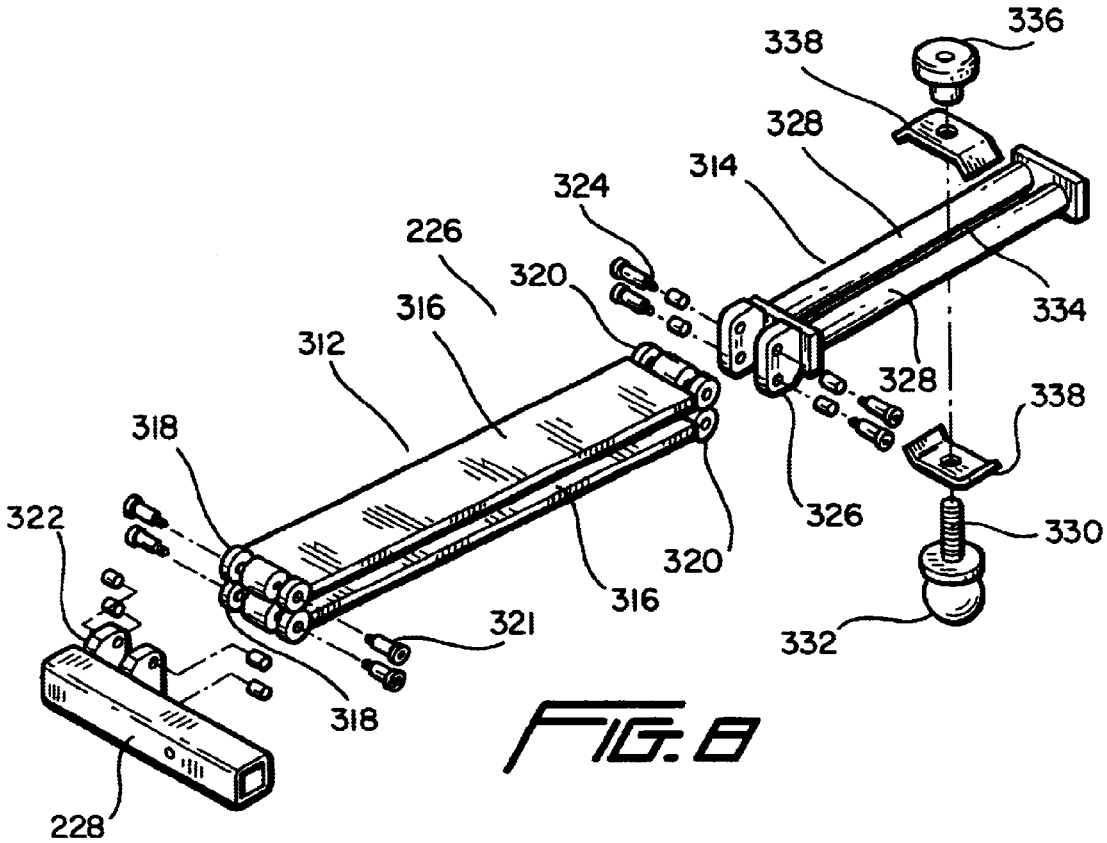
FIG. 8 is an exploded perspective view of the new and improved hitch mechanism constructed in accordance with the principles and teachings of the present invention for interconnecting the towed vehicle to the roadwork service vehicle.
Figure 9:
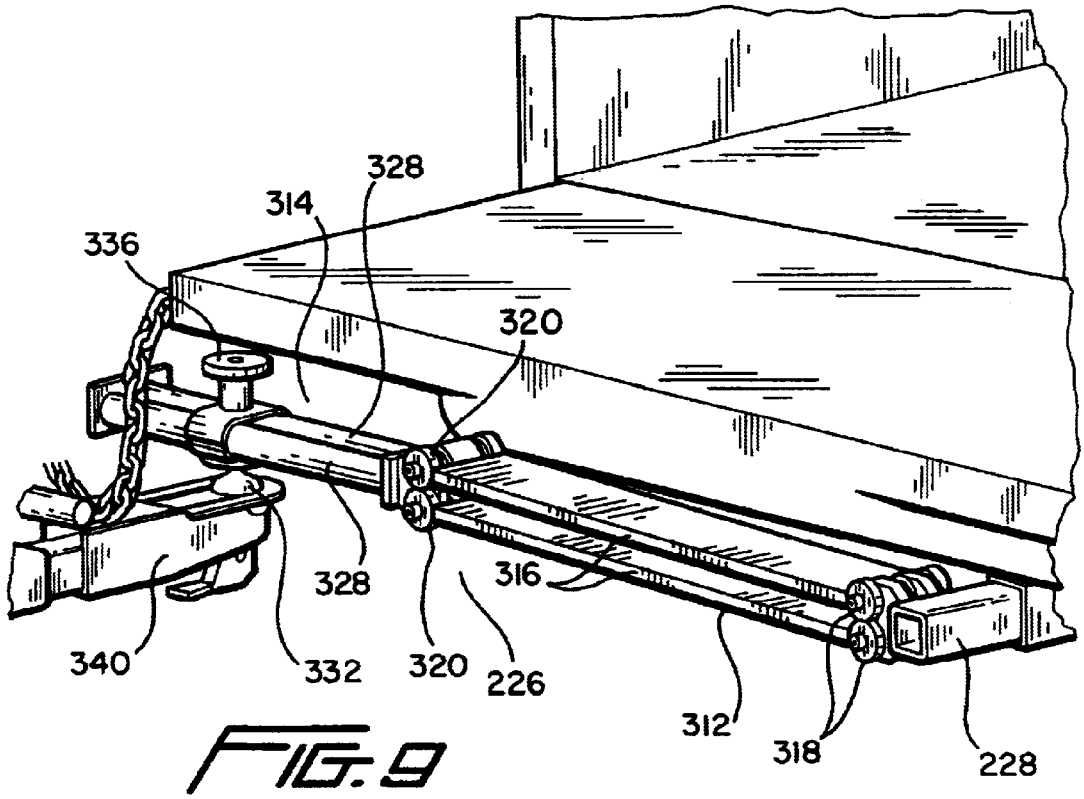
FIG. 9 is a perspective view illustrating the new and improved hitch mechanism, as disclosed within FIG. 8, as attached to both the towed vehicle and the roadwork service vehicle wherein the hitch mechanism is disposed within a non-pivoted horizontally oriented mode.
Figure 10:
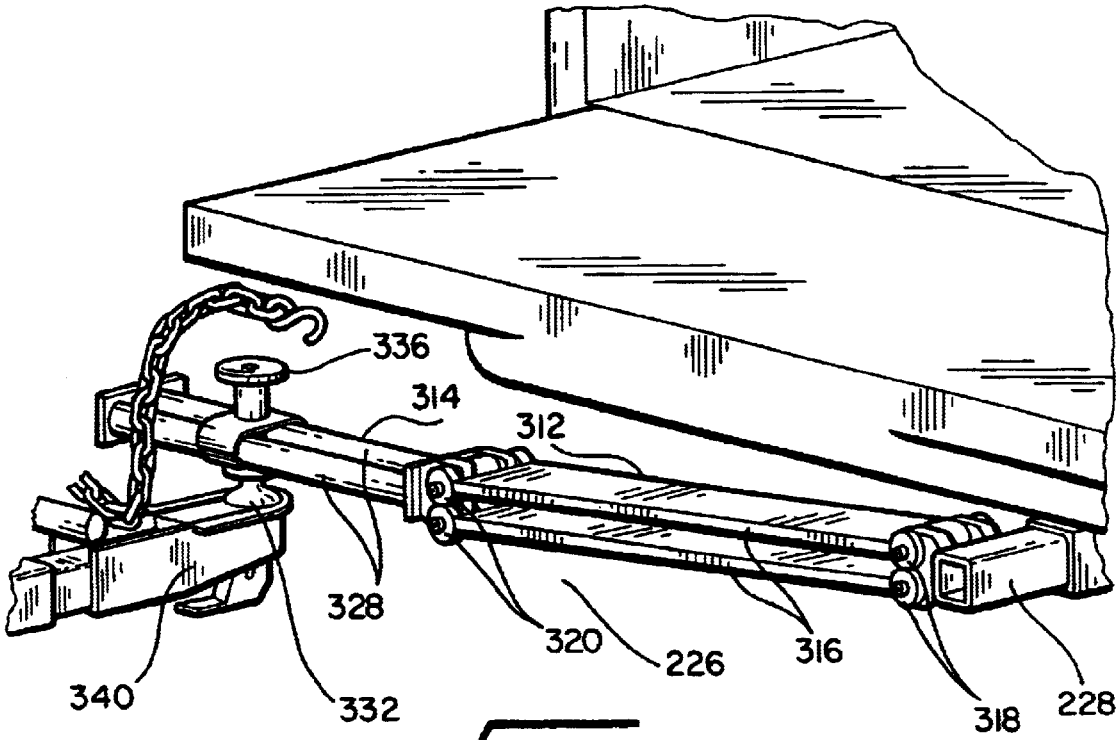
FIG. 10 is a view similar to that of FIG. 9 showing, however, the hitch mechanism as disposed within a slightly downwardly inclined pivotal mode.
Figure 11:
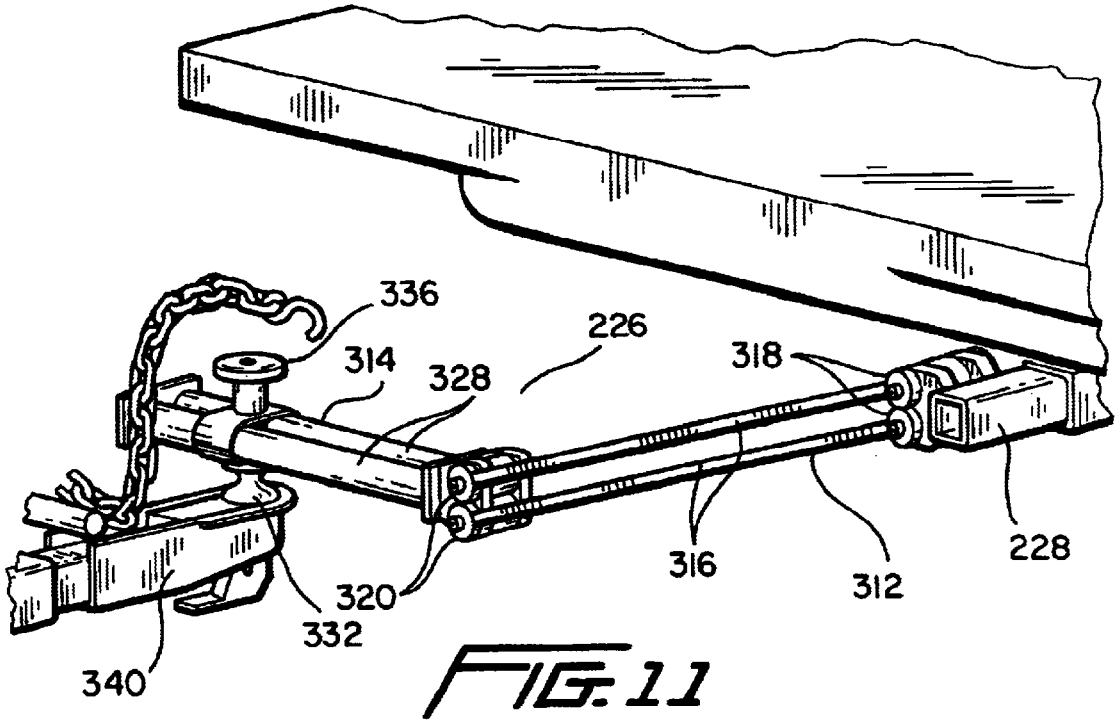
FIG. 11 is a view similar to those of FIGS. 9 and 10 showing, however, the hitch mechanism as disposed within a substantially downwardly inclined pivotal mode.

In this manner, when the new and improved apparatus or machine 210 of the present invention is to be used for automatically applying temporary raised pavement markers (TRPMs) 110 to the roadway surface 220, the transversely extending pivotal hitch connector 226 is operatively interconnected between the tow bar 224 of the trailer hitch assembly 218 and the fixed tubular mounting bar 228 of the roadwork service vehicle or truck 222 so as to properly position the wheeled vehicle 212 at it proper longitudinally offset position with respect to the roadwork service vehicle or truck 222, as disclosed within FIG. 4, whereby, for example, a plurality of temporary raised pavement markers (TRPMs) are adapted to be applied to the roadway surface 220 in dual sets of markers 110 so as to effectively simulate, for example, a double yellow line which conventionally separates oppositely directed or oncoming lanes of vehicular traffic. Alternatively, when the new and improved apparatus or machine 210 of the present invention is not being used for automatically applying temporary raised pavement markers (TRPMS) 110 to the roadway surface 220, and is adapted to be simply towed behind the roadwork service vehicle or truck 222 while the roadwork service vehicle or truck 222 is being operated at relatively high speed upon a highway, such as, for example, when the apparatus 210 of the present invention is being transported either to or from a work site, the transversely extending pivotal hitch connector 226 is removed and the tow bar 224 of the trailer hitch assembly 218 is connected directly to the fixed tubular mounting bar 228 of the roadwork service vehicle or truck 222 as disclosed within FIG. 12.

Figure 3:
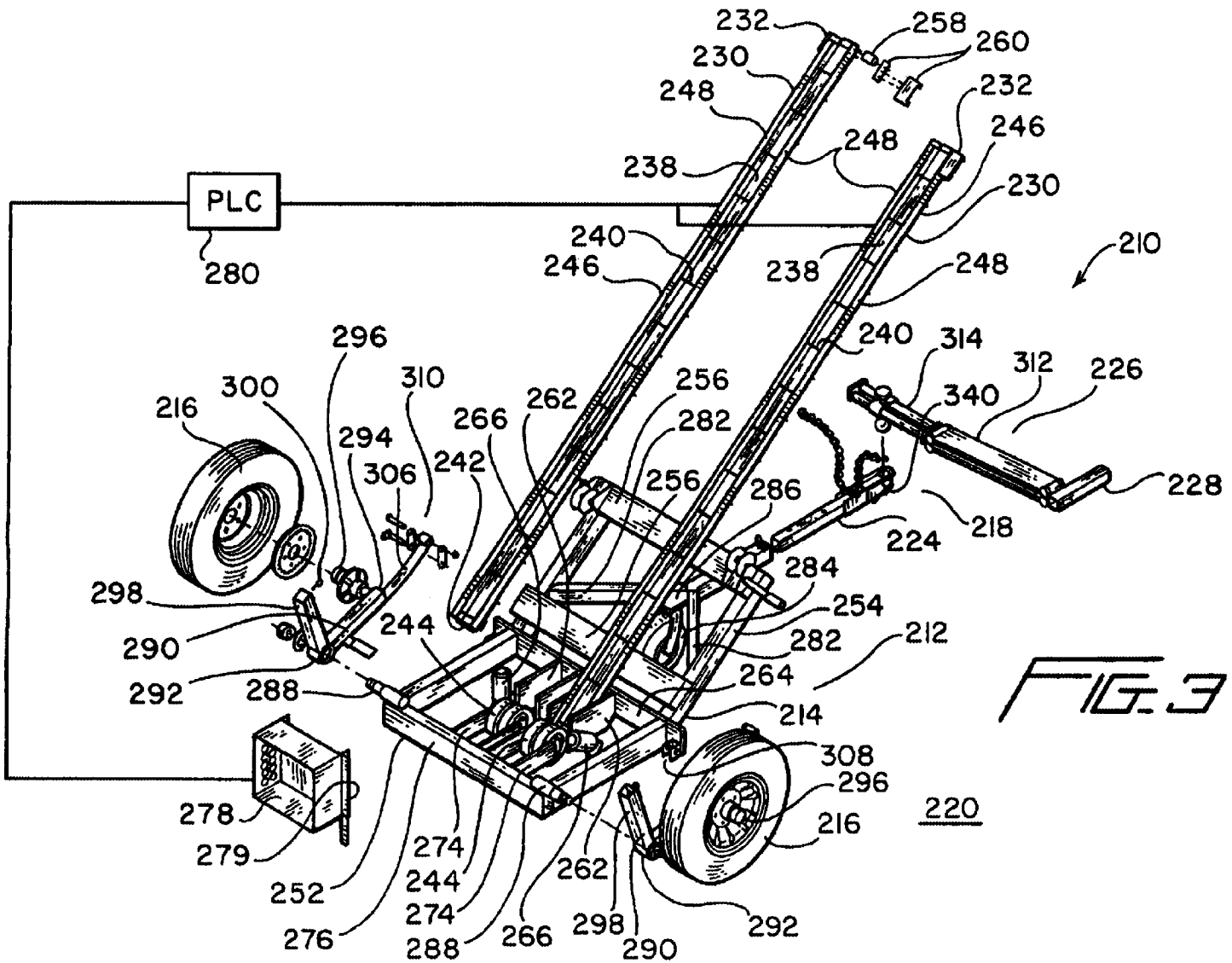
FIG. 3 is a partially exploded perspective view of a new and improved apparatus, as constructed in accordance with the principles and teachings of the present invention, for automatically applying temporary raised pavement markers (TRPMs) onto a roadway surface, as well as the new and improved hitch mechanism for interconnecting the towed vehicle, upon which the new and improved apparatus for automatically applying the temporary raised pavement markers (TRPMs) onto the roadway surface is mounted, to the roadwork service vehicle.
Figure 12:
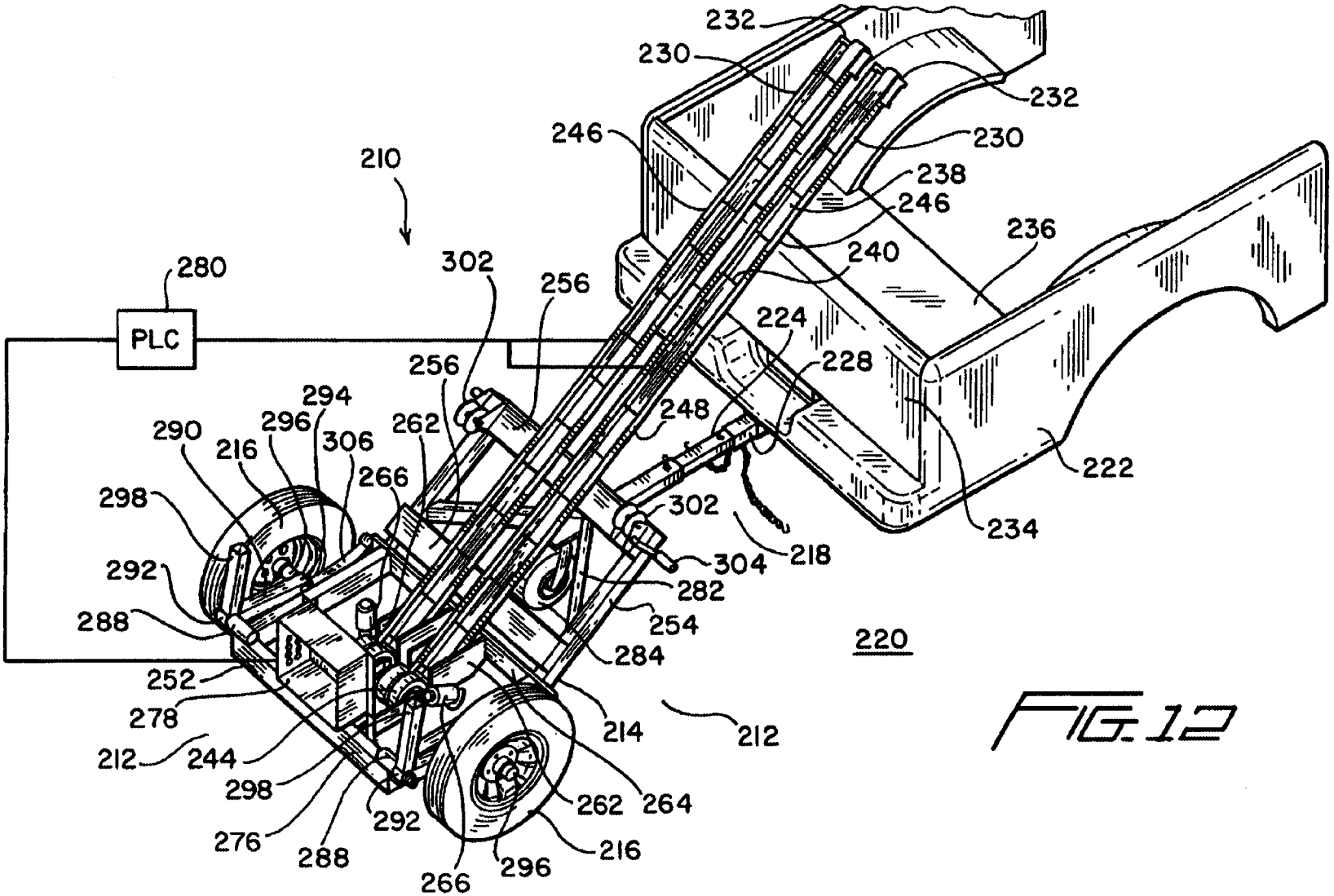
FIG. 12 is perspective view similar to that of FIG. 4 wherein, however, the hitch mechansism, as more specifically disclosed within FIGS. 8–11, has been removed such that the towed vehicle is attached directly to the roadwork service vehicle during the non-application, transportation mode of the new and improved apparatus of the present invention for automatically applying the temporary raised pavement markers (TRPMs) onto the roadway surface.

As can best be appreciated from FIGS. 3, 4, and 12, the new and improved apparatus or machine 210 of the present invention is seen to further comprise a pair of laterally or transversely spaced, longitudinally oriented inclined conveyor assemblies 230,230. Upper end portions 232, 232 of the inclined conveyor assemblies 230,230 are adapted to be disposed at an elevation which is above the tailgate portion 234 of the roadwork service vehicle or truck 222, as best seen in FIG. 4, such that when an operator or workman is, for example, standing upon the deck or bed 236 of the roadwork service vehicle or truck 222, the upper end portions 232,232 of the conveyor assemblies 230,230 are readily accessible to the operator or workman so as to enable the operator or workman to successively place the temporary raised pavement markers (TRPMS) 110 onto the conveyor assemblies 230,230. Each one of the conveyor assemblies 230,230 is seen to comprise a downwardly movable conveyor belt 238, and a plurality of upstanding carrier members 240 are fixedly mounted upon each conveyor belt 238. Individual ones of the temporary raised pavement markers (TRPMs) 110 are adapted to be respectively mounted upon the conveyor belt carriers 240 in a substantially inverted mode such that, after the release liner or sheet 120 has been removed from each one of the temporary raised pavement markers (TRPMS) 110, the transitional corner region 116 of each temporary raised pavement marker (TRPM) 110 extends upwardly away from the surface of the conveyor belt 238, the normally vertically oriented leg member 114 of the temporary raised pavement marker (TRPM) 110 is oriented in the upstream direction upon the conveyor belt 238, and the normally horizontally oriented leg member 112 of the temporary raised pavement marker (TRPM) 110 is oriented in the downstream direction upon the conveyor belt 238.

In this manner, when the individual temporary raised pavement markers (TRPMs) 110 are serially discharged from lower end portions 242,242 of the conveyor assemblies 230,230, which are adapted to be disposed directly above the roadway surface 220 as best seen in FIGS. 3 and 5–7, each one of the temporary raised pavement markers (TRPMS) 110 will be disposed, in effect, upon the roadway surface 220 in a knocked-down state whereby the normally vertically oriented leg member 114 of the temporary raised pavement marker (TRPM) 110 will be disposed horizontally upon the roadway surface 220 while the normally horizontally oriented leg member 116 of the temporary raised pavement marker (TRPM) 110 will be disposed vertically upwardly with respect to the roadway surface 220. Accordingly, a pair of applicator wheels 244,244, which are disposed immediately adjacent to each one of the lower end portions 242,242 of the conveyor assemblies 230,230, are able to immediately engage the horizontally disposed leg member 114 of the temporary raised pavement marker (TRPM) 110 so as to substantially retain the temporary raised pavement marker (TRPM) 110 at the particularly desired position upon the roadway surface 220 at which the temporary raised pavement marker (TRPM) 110 is to be applied to the roadway surface 220, and subsequently roll over the particular temporary raised pavement marker (TRPM) 110 so as to effectively upend the temporary raised pavement marker (TRPM) 110 to its normal orientation whereby the temporary raised pavement marker (TRPM) 110 will be secured to the roadway surface 220 by means of its adhesive pad 118.

With reference continuing to be made to FIGS. 3–7 and 12, it is seen that each one of the inclined conveyor assemblies 230,230 comprises a substantially U-shaped conveyor track member 246 comprising a pair of laterally or transversely spaced, upstanding side walls 248 and an upper support surface of a support member 250, interposed between the side walls 248, upon which the conveyor belt 238 is movably supported. The framework or chassis 214 comprises a horizontally disposed platform section 252 and an inclined framework section 254 integrally connected to the platform section 252, and it is further seen that the inclined framework section 254 comprises a pair of crossbars 256,256 to which lower end portions of the pair of conveyor track members 246 are fixedly secured by means of, for example, bolt fasteners, not shown. As has been noted, the conveyor belt 238 of each conveyor assembly 230 is adapted to be conducted along the upper support surface of the support member 250 of each conveyor track member 246, and is of course adapted to be routed along a return path which is disposed beneath the support member 250. Accordingly, as may best be appreciated from FIG. 3, the uppermost end portion of each conveyor assembly 230,230 is provided with an idler pulley 258 which is mounted upon the conveyor assemblies 230,230 by means of suitable mounting brackets 260, only one of the idler pulleys 258 actually being shown, and a drive pulley, not visible, is similarly provided at the lowermost end portion of each conveyor assembly 230,230.

As best seen in FIGS. 3, 5, 7, and 12, the lower-most end portion of each one of the conveyor assemblies 230, 230 is interposed between a pair of mounting brackets 262, 262 which are fixedly secured to a forwardly disposed member 264 of the horizontally disposed platform section 252 of the framework or chassis 214, and a conveyor drive motor 266 is mounted upon the laterally outer one of each pair of mounting brackets 262,262 by means of a suitable mounting bracket 268 and a plurality of mounting shafts 270 such that a motor drive shaft 272 of each conveyor drive motor 266 is operatively connected to the conveyor drive pulley, not shown. Substantially completing the structure of the horizontally disposed platform section 252 of the framework or chassis 214, it is seen that each set or pair of the plurality of temporary raised pavement marker (TRPM) applicator wheels 244 are mounted upon suitable mounting brackets 274 which are, in turn, fixedly mounted upon a rearwardly disposed frame member 276 of the horizontally disposed platform section 252 of the framework or chassis 214, and the axles of the temporary raised pavement marker (TRPM) applicator wheels 244 are operatively mounted within suitable enclosed spring assemblies 275 which are mounted upon the mounting brackets 274. An electronics housing 278, within which suitable electronics are disposed for the operation of, for example, the conveyor assemblies 230,230, is likewise fixedly mounted upon the horizontally disposed platform section 252 of the framework or chassis 214 by means of suitable mounting bracket and angle iron members 279, and the system electronics are adapted to be electronically connected to a suitable program logic controller (PLC) 280 which is provided for controlling, for example, the drive speed of the conveyor drive motors 266,266 such that the conveyor assemblies 230,230 can convey and discharge a predetermined number of temporary raised pavement markers (TRPMs) 110 within a predetermined period of time whereby the temporary raised pavement markers (TRPMs) 110 are applied to the roadway surface 220 at predeterminedly spaced positions therealong.

Continuing further, it is seen that the tow bar 224 of the trailer hitch assembly 218 is integrally connected to the inclined framework section 254 of the towed vehicle framework or chassis 214 by means of a pair of divergent angle bars or arms 282,282 which are arranged with respect to each other in a substantially V-shaped array, and that a third transport wheel assembly 284 is fixedly secured to the trailer hitch assembly 218 by means of a mounting bracket 286 which is secured to the pair of divergent angle bars or arms 282,282 at the junction of the V-shaped array. In accordance with a unique and novel feature characteristic of the present invention, the towed vehicle framework or chassis 214 is adapted to be movable between a first relatively lowered position with respect to the roadway surface 220, at which the plurality of temporary raised pavement marker (TRPM) applicator wheels 244 and the third transport wheel assembly 284 are adapted to be disposed in contact with the roadway surface 220, so as to facilitate the application of the plurality of temporary raised pavement markers (TRPMs) 110 onto the roadway surface 220, and a second relatively elevated position with respect to the roadway surface 220, at which the plurality of temporary raised pavement marker (TRPM) applicator wheels 244 and the third transport wheel assembly 284 are adapted to be disengaged from the roadway surface 220, such as, for example, when the plurality of temporary raised pavement markers (TRPMs) 110 are no longer being applied to the roadway surface 220, so as to facilitate, for example, high-speed travel of the towed vehicle 212 by means of the roadwork service vehicle or truck 222.

In order to achieve the elevational movements of the towed vehicle framework or chassis 214 between the aforenoted first and second positions with respect to the roadway surface 220, a pair of stub shafts 288,288 are fixedly secured to oppositely disposed, laterally spaced upper side portions of the rearwardly disposed frame member 276 of the horizontally disposed platform section 252 of the towed vehicle chassis or framework 214, and a pair of substantially L-shaped arms 290,290 are pivotally mounted, by means of collar portions 292,292 formed at the junctions defined between the leg portions forming the L-shaped arms 290,290, upon the stub shafts 288,288. In addition, first, substantially horizontally oriented end portions 294,294 of the L-shaped arms 290,290 are adapted to be pivotally mounted upon the axle assemblies 296,296 of the pair of transport wheels 216,216, while second opposite substantially vertically oriented or upstanding end portions 298,298 of the L-shaped arms 290,290 are adapted to have eyelet members 300,300 fixedly mounted therein. A pair of bail assemblies 302,302 are rotatably mounted upon the upper one of the cross-bars 256 of the inclined framework section 254 of the towed vehicle chassis or framework 214, and the bail members of the bail assemblies 302,302 are adapted to be rotated by means of suitable crank mechanisms 304 such that cables, not shown but having first end portions thereof respectively secured upon the bail members of the bail assemblies 302,302, and having second end portions thereof fixedly connected to the eyelets 300,300 fixedly mounted within the upper end portions 298,298 of the L-shaped arm members 290,290, can be wound upon the bail members of the bail assemblies 302,302.

Accordingly, as the cables are wound upon the bail members of the bail assemblies 302,302, the L-shaped arms 290,290 will be pivoted from their substantially inclined positions as shown in FIG. 4 to their substantially vertically oriented positions as shown in FIG. 12. It is to be appreciated, however, that in view of the fact that the L-shaped arms 290,290 are pivotally mounted at their first end portions 294,294 upon the axle assemblies 296,296 of the transport wheels 216,216, and in view of the additional fact that the axle assemblies 296,296 of the transport wheels 216,216 will not move elevationally because the transport wheels 216,216 are always rollably disposed upon the roadway surface 220, then the L-shaped arms 290,290 will effectively pivot or move in an arcuate manner around the axes defined by means of the transport wheel axles 296,296. Consequently, in view of the additional fact that the L-shaped arms 290, 290 are pivotally mounted by means of their collar portions 292,292 upon the stub shafts 288,288 which are fixed upon the rearwardly disposed frame member 276 of the horizontally disposed platform section 252 of the towed vehicle chassis or framework 214, then it is to be appreciated that as the L-shaped arms 290,290 are pivotally moved in their arcuate mode from their substantially inclined positions as shown in FIG. 4 to their substantially vertically oriented positions as shown in FIG. 12, the entire towed vehicle framework or chassis 214 will accordingly be pivoted as additionally permitted by means of the universal ball member assembly, not shown in FIG. 12 but which will be discussed hereinafter, which conventionally connects the tow bar 224 of the trailer hitch assembly 218 to the mounting bar 228 of the roadwork service vehicle or truck 222. It is to be noted further that the bail assemblies 302,302 are provided with suitable pawl mechanisms, not shown, such that the cables wound upon the bail assemblies 302,302 may be optionally retained in any one of a multitude of wound states, or released, as desired.

It is lastly noted in conjunction with the overall structure of the towed vehicle framework or chassis 214, and the mounting of the same upon the pair of transport wheels 216,216, that, as best seen in FIGS. 3, 4, 6, and 12, a pair of leaf spring members 306,306 have first end portions thereof respectively connected to the first end portions 294,294 of the L-shaped arms 290,290, while second end portions of the leaf spring members 306,306 are adapted to be connected to mounting brackets 308,308 fixedly disposed upon opposite end portions of the forwardly disposed member 264 of the horizontally disposed platform section 252 of the framework or chassis 214 by means of suitable fastener assemblies 310,310. It is noted further, as can best be respectively appreciated from FIGS. 4 and 12, that when the temporary raised pavement marker (TRPM) applicator apparatus 210 of the present invention is disposed in its temporary raised pavement marker (TRPM) applicator mode, that is, when the framework or chassis 214 is disposed at its elevationally lowered position such that the two sets of temporary raised pavement marker (TRPM) applicator wheels 244, as well as the third transport wheel 284, are disposed upon the roadway surface, the leaf spring members 306,306 are disconnected from the mounting brackets 308 of the framework or chassis 214, whereas when the temporary raised pavement marker (TRPM) applicator apparatus 210 of the present invention is disposed in its high-speed transportation mode, that is, when the framework or chassis 214 is disposed at its elevationally raised position such that the two sets of temporary raised pavement marker (TRPM) applicator wheels 244, as well as the third transport wheel 284, are disengaged from the roadway surface, the leaf spring members 306,306 are connected to the mounting brackets 308 of the framework or chassis 214.

With reference lastly being made to FIGS. 3, 4, and 8–11, the new and improved transversely extending pivotal hitch connector 226 of the present invention will now be described. As has been noted hereinbefore, the new and improved hitch connector 226 is adapted to be utilized with the temporary raised pavement marker (TRPM) applicator apparatus 210 of the present invention only when the temporary raised pavement marker (TRPM) applicator apparatus 210 of the present invention is disposed in its temporary raised pavement marker (TRPM) application mode, whereas, when the temporary raised pavement marker (TRPM) applicator apparatus 210 of the present invention is disposed in its high-speed transportation mode, the new and improved hitch connector 226 of the present invention is adapted to be disconnected and removed from the temporary raised pavement marker (TRPM) applicator apparatus 210 of the present invention whereby, for example, the towed vehicle 212 is adapted to be directly connected to the roadwork service vehicle or truck 222 as disclosed within FIG. 12. More particularly, as can best be appreciated from FIG. 8, the new and improved hitch connector 226 of the present invention is seen to comprise two primary components, the first one of which is a dual-plate pivotal connector 312, and the second one of which is a dual-rod lateral adjustment connector 314.

The dual-plate pivotal connector 312 is seen to comprise a pair of vertically spaced parallel plates 316,316 wherein each one has a pair of pivotal collars 318,320 at opposite ends thereof. The first set of pivotal collars 318 are adapted to be pivotally connected, by means of suitable fastener assemblies 321, to mounting brackets 322 which are fixedly secured to the mounting bar 228 of the roadwork service vehicle or truck 222, while the second set of pivotal collars 320,320 are adapted to be pivotally connected, by means of suitable fastener assemblies 324, to mounting brackets 326 which are fixedly secured to one end of the dual-rod lateral adjustment connector 314. The dual-rod lateral adjustment connector 314 is seen to comprise a pair of transversely extending rods 328,328 which are separated from each other so as to permit a threaded rod portion 330 of a trailer hitch universal ball member 332 to extend through the space 334 defined between the pair of rods 328,328 and thereby be threadedly engaged with a nut member 336. A pair of mounting plates 338,338 are adapted to be disposed in slidable engagement with upper and lower surface portions of the rods 328,328 so as to effectively define a slidable mounting system for the universal ball-nut assembly 332–336. In this manner, when the universal ball member 332 is engaged with a socket member 340 operatively disposed upon the tow bar 224 of the trailer hitch assembly 218, and the relative position of the universal ball member 332 and the tow bar 224 of the trailer hitch assembly 218 are transversely or laterally adjusted with respect to the adjustment connector 314, the lateral or transverse disposition of the entire towed vehicle 212 with respect to the roadwork service vehicle or truck 222 can be positionally adjusted as desired or required. The interdisposition of the pivotal connector 312 between the adjustment connector 314, which is connected to the tow bar 224 of the towed vehicle 212, and the mounting bar 228, which is connected to the roadwork service vehicle or truck 222, provides for a pivotal connection to be established between the tow bar 224 of the towed vehicle 212 and the mounting bar 228 of the roadwork service vehicle or truck 222 which effectively permits the towed vehicle 212 to experience different elevational movements independent of or with respect to the roadwork service vehicle or truck 222 as may be appreciated, for example, from FIGS. 9–11.

Thus, it may be seen that in accordance with the principles and teachings of the new and improved automatic apparatus for applying temporary raised pavement markers (TRPMs) to roadway surfaces, there has been disclosed a conveyor for serially feeding a plurality of temporary raised pavement markers (TRPMs) from an upper elevational position, which is accessible by means of operator or workmen personnel disposed within the roadwork vehicle or truck, to a lower elevational position which is located immediately above the roadway surface onto which the temporary raised pavement markers (TRPMs) are to be applied. In addition, there is also disclosed a new and improved trailer hitch mechanism which provides for the independent elevational movement of the towed vehicle with respect to the towing roadwork service vehicle or truck.

Obviously, many variations and modifications of the present invention are possible in light of the above teachings. For example, while the trailer hitch assembly 218 has been disclosed as being connected directly to the mounting bar 228 of the roadwork service vehicle or truck 222 when the apparatus of the present invention is not being utilized for applying temporary raised pavement markers (TRPMs) to the roadway surface and is disposed in its high-speed transport mode, the trailer hitch assembly 218 can of course be connected to the moutilng bar 228 of the roadwork service vehicle or truck 222 by means of a conventional universal ball connection system. It is therefore to be understood that within the scope of the appended claims, the present invention may be practiced otherwise than as specifically described herein.

What is claimed as new and desired to be protected by Letters Patent of the United States of America, is:

1. Apparatus for automatically serially applying a plurality of pavement markers to a roadway surface, as a result of said apparatus being attached to a roadwork vehicle and thereby moving along the roadway surface with the roadwork vehicle, comprising:

means for attaching said apparatus to a roadwork vehicle whereby said apparatus can be moved along the roadway surface as the roadwork vehicle moves along the roadway surface;

conveyor means for serially conveying a plurality of pavement markers, from an upstream end portion which is disposed at an upper elevational level so as to be accessible by an operator disposed upon the roadwork vehicle such that a plurality of pavement markers can be serially deposited upon said conveyor means by the operator disposed upon the roadwork vehicle, to a downstream end portion which is disposed at a lower elevational level disposed immediately above the roadway surface onto which the plurality of pavement markers are to be deposited, such that the plurality of pavement markers can be serially discharged from said downstream end portion of said conveyor means and serially deposited at predeterminedly spaced locations along the roadway surface; and applicator means disposed adjacent to said downstream end portion of said conveyor means for operatively engaging each individual one of the plurality of pavement markers, deposited onto the roadway surface by said conveyor means, so as to serially apply the plurality of pavement markers onto the roadway surface at the predeterminedly spaced locations along the roadway surface.

2. The apparatus as set forth in claim 1, wherein said conveyor means comprises:

a conveyor belt movably mounted upon said conveyor means;

a plurality of carrier elements fixedly disposed at predeterminedly spaced positions along said conveyor belt for respectively seating the plurality of pavement markers thereon on so as to serially convey the plurality of pavement markers along said conveyor means; and conveyor belt drive means operatively connected to said conveyor belt for moving said conveyor belt along said conveyor means.

3. The apparatus as set forth in claim 1, further comprising:

a wheeled vehicle comprising a vehicle chassis;

a pair of laterally spaced transport wheels mounted upon said vehicle chassis for permitting said wheeled vehicle to be moved along the roadway surface;

said lower downstream end portion of said conveyor means is fixedly mounted upon said vehicle chassis; and said applicator means comprises a wheel applicator for rollably engaging individual ones of the plurality of pavement markers deposited onto the roadway surface by said conveyor means in order to individually apply the plurality of pavement markers to the roadway surface at the predeterminedly spaced locations along the roadway surface.

4. The apparatus as set forth in claim 3, wherein:

said conveyor means comprises a pair of parallel conveyors; and said applicator means comprises a pair of applicator wheels for respectively rollably engaging individual ones of the plurality of pavement markers deposited onto the roadway surface by said pair of parallel conveyors in order to individually apply the plurality of pavement markers along a pair of lines simulating traffic lane lines of demarcation.

5. The apparatus as set forth in claim 3, further comprising:

a pair of arms respectively pivotally mounted upon said vehicle chassis and respectively pivotally mounted upon said pair of transport wheels so as to permit said vehicle chassis to be pivotally movable, with respect to said pair of transport wheels, between a first position at which said applicator wheel is able to be engaged with the roadway surface when it is desired to individually apply the pavement markers onto the roadway surface, and a second position at which said applicator wheel is elevationally disengaged from the roadway surface when it is not desired to apply the roadway markers onto the roadway surface.

6. The apparatus as set forth in claim 5, further comprising:

a program logic controller (PLC) operatively connected to said conveyor belt drive means for driving said conveyor belt at a predetermined rate of speed such that a predetermined number of the plurality of pavement markers are conveyed along said conveyor means, discharged from said lower end portion of said conveyor means, and deposited onto the roadway surface at the predeterminedly spaced locations along the roadway surface.

7. The apparatus as set forth in claim 3, further comprising:

a third transport wheel mounted upon said vehicle chassis and disposed forwardly of said pair of transport wheels for cooperating with said pair of transport wheels for permitting said wheeled vehicle to be moved along the roadway surface.

8. The apparatus as set forth in claim 3, further comprising:

a tow bar fixedly mounted upon said vehicle chassis so as to permit said wheeled vehicle to be towed by the roadwork vehicle; and a hitch connector operatively interconnecting said tow bar of said vehicle chassis to a mounting bar of the roadwork vehicle;

said hitch connector comprising first hinge means disposed at a first end portion thereof for hingedly connecting said hitch connector to said tow bar of said vehicle chassis, and second hinge means disposed at a second end portion thereof for hingedly connecting said hitch connector to the mounting bar of the roadwork vehicle whereby said first and second hinge means of said hitch connector permit said wheeled vehicle to be elevationally movable independently of the roadwork vehicle.

9. The apparatus as set forth in claim 8, wherein said hitch connector further comprises:

adjustment means interconnecting said first hinge means to said tow bar of said vehicle chassis for permitting transverse adjustment of said tow bar of said vehicle chassis with respect to the mounting bar of the roadwork vehicle so as to permit transverse positional adjustment of said wheeled vehicle with respect to the roadwork vehicle.

10. In combination, apparatus for automatically serially applying a plurality of pavement markers to a roadway surface as a result of said apparatus moving along the roadway surface, comprising:

a roadwork vehicle;

a wheeled vehicle;

means operatively connecting said wheeled vehicle to said roadwork vehicle whereby said wheeled vehicle can be moved along the roadway surface as said roadwork vehicle moves along the roadway surface;

conveyor means for serially conveying a plurality of pavement markers, from an upstream end portion which is disposed at an upper elevational level so as to be accessible by an operator disposed upon the roadwork vehicle such that a plurality of pavement markers can be serially deposited upon said conveyor means by the operator disposed upon the roadwork vehicle, to a downstream end portion which is disposed at a lower elevational level disposed immediately above the roadway surface onto which the plurality of pavement markers are to be deposited, such that the plurality of pavement markers can be serially discharged from said downstream end portion of said conveyor means and serially deposited at predeterminedly spaced locations along the roadway surface; and applicator means disposed adjacent to said downstream end portion of said conveyor means for operatively engaging each individual one of the plurality of pavement markers, deposited onto the roadway surface by said conveyor means, so as to serially apply the plurality of pavement markers onto the roadway surface at the predeterminedly spaced locations along the roadway surface.

11. The combination set forth in claim 10, wherein said conveyor means comprises:

a conveyor belt movably mounted upon said conveyor means;

a plurality of carrier elements fixedly disposed at predeterminedly spaced positions along said conveyor belt for respectively seating the plurality of pavement markers thereon so as to serially convey the plurality of pavement markers along said conveyor means; and conveyor belt drive means operatively connected to said conveyor belt for moving said conveyor belt along said conveyor means.

12. The combination set forth in claim 10, wherein:

said wheeled vehicle comprises a vehicle chassis;

a pair of laterally spaced transport wheels are mounted upon said vehicle chassis for permitting said wheeled vehicle to be moved along the roadway surface;

said lower downstream end portion of said conveyor means is fixedly mounted upon said vehicle chassis; and said applicator means comprises a wheel applicator for rollably engaging individual ones of the plurality of pavement markers deposited onto the roadway surface by said conveyor means in order to individually apply the plurality of pavement markers to the roadway surface at the predeterminedly spaced locations along the roadway surface.

13. The combination as set forth in claim 12, wherein:

said conveyor means comprises a pair of parallel conveyors; and said applicator means comprises a pair of applicator wheels for respectively rollably engaging individual ones of the plurality of pavement markers deposited onto the roadway surface by said pair of parallel conveyors in order to individually apply the plurality of pavement markers along a pair of lines simulating traffic lane lines of demarcation.

14. The combination as set forth in claim 12, further comprising:

a pair of arms respectively pivotally mounted upon said vehicle chassis and respectively pivotally mounted upon said pair of transport wheels so as to permit said vehicle chassis to be pivotally movable, with respect to said pair of transport wheels, between a first position at which said applicator wheel is able to be engaged with the roadway surface when it is desired to individually apply the pavement markers onto the roadway surface, and a second position at which said applicator wheel is elevationally disengaged from the roadway surface when it is not desired to apply the roadway markers onto the roadway surface.

15. The combination as set forth in claim 14, further comprising:

a program logic controller (PLC) operatively connected to said conveyor belt drive means for driving said conveyor belt at a predetermined rate of speed such that a predetermined number of the plurality of pavement markers are conveyed along said conveyor means, discharged from said lower end portion of said conveyor means, and deposited onto the roadway surface at the predeterminedly spaced locations along the roadway surface.

16. The combination as set forth in claim 12, further comprising:

a third transport wheel mounted upon said vehicle chassis and disposed forwardly of said pair of transport wheels for cooperating with said pair of transport wheels for permitting said wheeled vehicle to be moved along the roadway surface.

17. The combination as set forth in claim 12, wherein said means for operatively connecting said wheeled vehicle to said roadwork vehicle comprises:

a tow bar fixedly mounted upon said vehicle chassis so as to permit said wheeled vehicle to be towed by said roadwork vehicle; and a hitch connector operatively interconnecting said tow bar of said vehicle chassis to a mounting bar of said roadwork vehicle;

said hitch connector comprising first hinge means disposed at a first end portion thereof for hingedly connecting said hitch connector to said tow bar of said vehicle chassis, and second hinge means disposed at a second end portion thereof for hingedly connecting said hitch connector to the mounting bar of said roadwork vehicle whereby said first and second hinge means of said hitch connector permit said wheeled vehicle to be elevationally movable independently of said roadwork vehicle.

18. The combination as set forth in claim 17, wherein said hitch connector further comprises:

adjustment means interconnecting said first hinge means to said tow bar of said vehicle chassis for permitting transverse adjustment of said tow bar of said vehicle chassis with respect to said mounting bar of said roadwork vehicle so as to permit transverse positional adjustment of said wheeled vehicle with respect to said roadwork vehicle.

19. The combination as set forth in claim 18, wherein said adjustment means further comprises:

a pair of longitudinally spaced, transversely extending rods;

a universal ball assembly mounted upon said tow bar of said vehicle chassis; and fastener means operatively connected to said universal ball assembly and adjustably connected to said pair of longitudinally spaced, transversely extending rods so as to permit said transverse adjustment of said tow bar of said vehicle chassis with respect to said mounting bar of said roadwork vehicle so as to permit said transverse positional adjustment of said wheeled vehicle with respect to said roadwork vehicle.

20. A method, for automatically serially applying a plurality of pavement markers to a roadway surface by means of apparatus attached to a roadwork vehicle whereby the apparatus can move along the roadway surface with the roadwork vehicle, comprising the steps of:

attaching the apparatus to a roadwork vehicle such that the apparatus can be moved along the roadway surface as the roadwork vehicle moves along the roadway surface;

serially conveying a plurality of pavement markers, from an upstream end portion of a conveyor which is disposed at an upper elevational level so as to be accessible by an operator disposed upon the roadwork vehicle such that a plurality of pavement markers can be serially deposited upon said conveyor by the operator disposed upon the roadwork vehicle, to a downstream end portion of said conveyor which is disposed at a lower elevational level located immediately above the roadway surface onto which the plurality of pavement markers are to be deposited, such that the plurality of pavement markers can be serially discharged from said downstream end portion of said conveyor and serially deposited at predeterminedly spaced locations along the roadway surface; and disposing applicator means adjacent to said downstream end portion of said conveyor for operatively engaging each individual one of the plurality of pavement markers, deposited onto the roadway surface by said conveyor, so as to serially apply the plurality of pavement markers onto the roadway surface at the predeterminedly spaced locations along the roadway surface.

21. The method as set forth in claim 20, further comprising the steps of:

conveying the pavement markers along a pair of parallel conveyors; and using a pair of applicator wheels for respectively rollably engaging individual ones of the plurality of pavement markers deposited onto the roadway surface by said pair of parallel conveyors in order to individually apply the plurality of pavement markers along a pair of lines simulating traffic lane lines of demarcation.

22. The method as set forth in claim 20, further comprising the step of:

using a wheel applicator for rollably engaging individual ones of the plurality of pavement markers deposited onto the roadway surface in order to individually apply the plurality of pavement markers to the roadway surface at the predeterminedly spaced locations along the roadway surface.

23. The method as set forth in claim 20, further comprising the steps of:

providing the apparatus as a wheeled vehicle.

24. The method as set forth in claim 23, further comprising the steps of:

fixedly mounting a tow bar upon said wheeled vehicle so as to permit said wheeled vehicle to be towed by said roadwork vehicle; and operatively interconnecting said tow bar of said wheeled vehicle to a mounting bar of said roadwork vehicle by a hitch connector comprising first hinge means for hingedly connecting a first end portion of said hitch connector to said tow bar of said wheeled vehicle, and second hinge means for hingedly connecting a second end portion of said hitch connector to said mounting bar of said roadwork vehicle whereby said first and second hinge means of said hitch connector permit said wheeled vehicle to be elevationally movable independently of said roadwork vehicle.

25. The method as set forth in claim 24, further comprising the step of:

adjustably interconnecting said first hinge means to said tow bar of said wheeled vehicle for permitting transverse adjustment of said tow bar of said wheeled vehicle with respect to said mounting bar of said roadwork vehicle so as to permit transverse positional adjustment of said wheeled vehicle with respect to said roadwork vehicle.

26. The method as set forth in claim 25, wherein the step of adjustably interconnecting said first hinge means to said tow bar of said wheeled vehicle comprises the steps of:

providing a pair of longitudinally spaced, transversely extending rods;

mounting a universal ball assembly upon said tow bar of said vehicle chassis; and operatively connecting fastener means to said universal ball assembly and adjustably connecting said fastener means to said pair of longitudinally spaced, transversely extending rods so as to permit said transverse adjustment of said tow bar of said vehicle chassis with respect to said mounting bar of said roadwork vehicle so as to permit said transverse positional adjustment of said wheeled vehicle with respect to said roadwork vehicle.

* * * * *